US005370281A

United States Patent [19]

Renault

[11] Patent Number: 5,370,281

[45] Date of Patent: Dec. 6, 1994

[54] ASSEMBLY FOR SPRAYING A LIQUID, INCLUDING A PRECOMPRESSION PUMP

[75] Inventor: Philippe Renault, Paris, France

[73] Assignee: L'Oreal, Paris, France

[21] Appl. No.: 168,387

[22] Filed: Dec. 17, 1993

[30] Foreign Application Priority Data

Dec. 28, 1992 [FR] France ..... 92 15768

[51] Int. Cl.[5] ..... B67D 5/40

[52] U.S. Cl. ..... 222/341; 222/383; 222/402.13

[58] Field of Search ..... 222/321, 324, 383, 340, 222/341, 402.13, 402.15; 239/333

[56] References Cited

U.S. PATENT DOCUMENTS

| | | | |
|---|---|---|---|
| 3,333,549 | 8/1967 | Cooprider | 222/383 X |
| 3,379,381 | 4/1968 | Decaux | 222/383 X |
| 3,770,206 | 11/1973 | Tada | 222/383 X |
| 3,897,006 | 7/1975 | Tada . | |
| 4,046,292 | 9/1977 | Corsette | 222/383 |
| 4,053,086 | 10/1977 | DeBard | 222/341 X |
| 4,061,250 | 12/1977 | Tada | 222/321 |
| 4,124,148 | 11/1978 | Vieler et al. | 222/321 |
| 4,173,297 | 11/1979 | Pettersen | 222/321 |
| 4,174,056 | 11/1979 | Loeffler | 222/321 |
| 4,183,449 | 1/1980 | Blake | 222/321 |
| 4,186,855 | 2/1980 | Edman et al. | 222/321 |
| 4,189,064 | 2/1980 | O'Neill et al. | 222/321 |
| 4,271,990 | 6/1981 | Kutik et al. . | |
| 4,274,560 | 6/1981 | Cater | 222/383 X |
| 4,365,729 | 12/1982 | Saito et al. | 222/321 |
| 4,923,094 | 5/1990 | O'Neill | 222/383 X |
| 4,930,999 | 6/1990 | Brunet et al. | 222/321 X |
| 5,181,635 | 1/1993 | Balderrama et al. | 222/341 X |
| 5,242,090 | 9/1993 | Reyss | 222/321 |

FOREIGN PATENT DOCUMENTS 2634825 2/1990 France .

*Primary Examiner*—Kevin P. Shaver
*Attorney, Agent, or Firm*—Young & Thompson

[57] ABSTRACT

An assembly for spraying a liquid comprises a dispensing head (3) fixed onto a container (2). The dispensing head (3) includes two chambers (34, 35) aligned on the same longitudinal axis and contained in a single body (33). The two chambers are separated by a transverse partition (39). The first chamber (34) is closed by a piston mounted so as to slide with respect to a rod (7). The rod (7) carries, at its end opposite the piston (6), a point (71) whose seat is the opening (37) for communication between the first chamber (34) and the second chamber (35), which opening is made in the partition (39). The first chamber (34) is connected to the container (2) by a non-return valve (9). The second chamber (35) is provided with a spray nozzle (11) which, being located on a fixed wall, is itself fixed.

18 Claims, 5 Drawing Sheets

ASSEMBLY FOR SPRAYING A LIQUID, INCLUDING A PRECOMPRESSION PUMP

FIELD OF THE INVENTION

The present invention relates to an assembly for spraying a liquid, including a precompression pump.

BACKGROUND OF THE INVENTION

Spray assemblies are known which consist of a container, on the neck of which a dispensing head is fixed, including a pump of the precompression type. These assemblies are used in numerous fields, in particular in cosmetics, for spraying liquids of greater or lesser viscosity, which may optionally have the consistency of a cream or a fluid paste, in particular perfumes.

Precompression pumps are pumps which generally include two chambers: a first chamber in which the liquid to be sprayed is introduced via a non-return valve and in which it is subjected to precompression using a piston, which is generally actuated manually from the outside against the action of an elastic return device, and a second chamber connected to a nozzle for spraying the liquid. The precompression of the liquid in the first chamber is intended to ensure a good spraying quality, from the start of the spraying.

Since pumps used in cosmetics are generally small, it is desired to manufacture pumps which contain as few pieces as possible. The present invention relates to an assembly in which the dispensing head including the pump contains a reduced number of pieces, which makes it easier to assemble.

SUMMARY OF THE INVENTION

The subject of the present invention is an assembly for spraying a liquid, consisting of a container containing the liquid to be sprayed, on the neck of which container a dispensing head is fixed, including a precompression pump including two chambers: a first precompression chamber, closed by a piston actuated manually from the outside against the action of at least one elastic return means and in communication with the container via a non-return valve, and a second chamber capable of communicating with the first chamber at the end of the precompression phase and including a spray nozzle, characterized in that the two chambers are aligned on the same longitudinal axis, that the walls of the two chambers are fixed and constitute a single body, that the piston is mounted so as to slide with respect to a rod provided with a point capable of opening and closing communication between the first and second chambers, and that the spray nozzle is located on a fixed wall of the second chamber.

This embodiment makes it possible to reduce the number of pieces required, because both chambers are contained in the same body. Furthermore, the spray nozzle is fixed, which limits the size of the window for outlet of the liquid jet sprayed when the dispensing head is covered with a cover. The risk of the liquid jet sprayed encountering the edge of the window, and consequently losses of sprayed liquid, is limited.

According to the present invention, the dispensing head may therefore be assembled solely from the following pieces:

- a single body containing the two chambers;
- a piston sliding in the first chamber;

- a rod carrying a point mounted so as to slide with respect to the pistons;
- at least one elastic return means connecting the piston to the rod;
- a spray nozzle located in the wall of the body at the second chamber,
- a moving body, in particular a ball, if the non-return valve is a ball valve.

The dispensing head may also include an additional piece: a cap closing the body, which is provided with an opening through which the piston passes, and which has the function of preventing the piston from being able to leave the body.

The body has a cylindrical general shape, the two chambers being separated by a transverse partition including an opening forming a passage between the first chamber and the second chamber, the orifice through which the second chamber emerges in the opening forming a seat for the point and allowing communication between the two chambers. Preferably, the body containing the two chambers carries a skirt allowing the body to be fixed onto the neck of the container. The body may also include a centering stud for the spray nozzle, integral with the partition separating the two chambers and located in the second chamber.

According to one embodiment of the body, the opening forming the seat for the non-return valve is made in the partition separating the two chambers; as a variant, it is made in the side wall of the body at the first chamber.

The body is preferably made of rigid plastic and obtained by moulding in a single piece.

The non-return valve is preferably a ball valve, but it might also be of any other known type of valve. It is, in a known manner, connected to an immersed tube contained in the container.

According to a first embodiment variant, the piston is a hollow piston and the rod is mounted so as to slide in the piston. In this first embodiment, the piston preferably consists of a hollow cylinder, carrying a flange provided with a sealing lip and closed at one end by a face capable of receiving the means of actuation of the piston; preferably, the face is provided with a vent hole to avoid compressing the air in the hollow cylinder of the piston, when the piston is driven in. The rod carries a lip which seals its sliding inside the piston. It preferably carries a flange whose diameter is less than that of the chamber on which the elastic return means of the piston bears.

According to a second embodiment variant, the rod is bored and the piston is mounted so as to slide in the rod. In this embodiment, the piston preferably consists of a cylindrical piece of small diameter so as to be able to penetrate the rod, this cylindrical piece being preferably hollow, so as to avoid compressing the air in the hollow rod; the cylindrical piece carries a disc having a diameter such that it can slide in a leaktight manner in the cylindrical body. The edge of the disc is preferably provided with a sealing lip. The rod includes, over part of its length, a cylindrical bore opening on the piston side. The upper edge of this bore is preferably provided with a sealing collar.

The dispensing head according to the invention may comprise, whatever the variant, a single elastic return means. This is advantageously located between the inner surface of the flange or of the disc of the piston and the flange of the rod.

The dispensing head may also include two elastic return means, which makes it possible to separate the force necessary to actuate the piston from the force necessary to obtain higher precompression. As elastic means, one (or more) springs are preferably used.

When the container containing the liquid is a rigid container, it is necessary for the assembly to include an air intake. This air intake may consist of any known means, for example a valve, in particular a ball valve including a ball, a spring and a seat, or a deformable seal and an element capable of deforming the seal.

The longitudinal axis of the body containing the two chambers may be arranged parallel or perpendicular to the axis of the spray nozzle.

The dispensing head may advantageously be protected by a cover fixed onto the container. When this cover is not removable and consequently remains in place during the dispensing, it includes a window located facing the spray nozzle, so as to allow the sprayed liquid jet to pass. The cover may then either be provided with an opening allowing the user to actuate the piston by pressing directly with one finger on the upper part of the piston, or with a lever system actuated manually by the user, which lever bears on the upper part of the piston.

The system functions in the following manner:

At rest, the piston is in the top position, the first chamber is full of liquid, the point rests in a leaktight manner on its seat and the non-return valve keeps communication between the container and the first chamber closed.

In order to actuate the spray assembly, the user presses on the upper part of the piston, either directly, or using a lever; the piston is driven in and compresses the elastic means. A hydraulic pressure is thus created within the first chamber.

When the sum of the force on the rod due to the pressure in the first chamber applied at the upper face of the flange and of the sealing lip plus the force due to the spring becomes less than the force on the rod due to the pressure in the first chamber applied to the sealing section of the lip, the point rises. The dose of liquid contained in the first chamber passes into the second chamber where it is sprayed through the nozzle. When the first chamber is empty, the point returns down to the opening on its seat. When the user stops pressing on the piston, the elastic return means return the piston into its rest position. A reduced pressure is created in the first chamber, the non-return valve opens and the liquid is sucked into the container. The assembly is then ready to be sprayed again.

BRIEF DESCRIPTION OF THE DRAWINGS

The description given hereinbelow, by way of illustration and without limitation, with reference to the attached drawings, will more clearly explain the invention.

In these drawings.

DETAILED DESCRIPTION OF THE INVENTION

Figure 2:
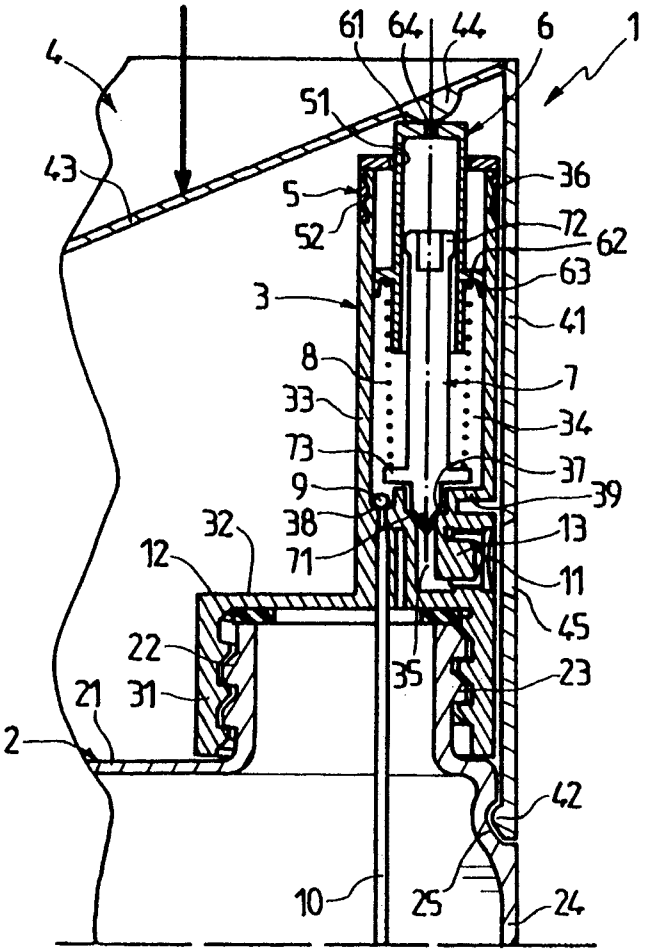
FIGS. 1 to 4 are views, in longitudinal section, of an assembly according to the invention in which the longitudinal axis of the body containing the two chambers is parallel to the axis of the spray nozzle and which includes only a single elastic return means, the assembly being represented at various stages of the spray process.

The assembly represented in FIGS. 1 to 4 is denoted in its entirety by the reference 1.

It is composed of a container 2, a dispensing head 3 and a cover 4. The container 2, which contains the liquid to be sprayed, is made of deformable material. It is provided with an upper wall 21 carrying, in the vicinity of its junction with a cylindrical side wall 24, a cylindrical neck 22 provided with an external screw thread 23. The neck 22 is off-center with respect to the longitudinal axis of the bottle. Furthermore, the side wall 24 of the container 2 includes, in the vicinity of its junction with the upper wall 21, an annular groove 25.

The dispensing head 3 includes a cylindrical skirt 31, which, according to the embodiment, is provided with an internal screw thread, capable of interacting with the external screw thread 23 of the neck 22. It is clear that the screw thread may be replaced by an attachment ring in the case of snap fastening, or by a smooth surface in the case of fastening by crimping. The cylindrical skirt 31 is connected, by a flat portion 32 which is transverse with respect to the skirt 31, to a body 33 of cylindrical general shape having a diameter less than that of the skirt 31. The side wall 24, the skirt 31 and the body 33 extend longitudinally along parallel axes. The body 33 defines two chambers 34 and 35 which are coaxial and separated by a transverse partition 39. The upper part, in the position represented in FIGS. 1 to 4, of the body 33 includes an external screw thread 36 which makes it possible to screw a cap 5 thereon. The partition 39 includes an opening 37 forming a cylindrical passage between the first chamber 34 and the second chamber 35. At the opening 37, the chamber 35 has a diameter less than that of the opening 37. Thus, the orifice through which the chamber 35 emerges in the opening 37 constitutes a seat for the point 71 of a rod 7, the purpose of which will be given below. The partition 39 separating the chambers 34 and 35 is provided with another opening 38 connecting the chamber 34 to the container 2, via an immersed tube 10. According to the embodiment represented in FIGS. 1 to 4, a non-return ball valve includes a ball 9 which interacts with the seat constituted by the opening 38, this opening having a frustoconical shape. In the first chamber 34, a hollow cylindrical piston 6 is mounted, which is closed on the side pointing towards the outside of the body 33 by a face 61 provided with a vent 64. The piston 6 carries a circular flange 62 provided with a sealing lip 63 interacting with the inner surface of the chamber 34. Inside the piston 6, the rod 7 is mounted in a leaktight manner, by virtue of a lip 72 with which it is provided, the piston 6 and the rod 7 sliding in each other. The end of the rod 7 which is opposite the piston 6 includes a conical zone forming the point 71 which is capable of closing or opening the opening 37. The rod 7 carries, in the vicinity of the point 71, above the latter, a flange 73 with a diameter less than that of the chamber 34.

A spring 8, surrounding the piston 6 and the rod. 7, connects the rod 7 to the piston 6. It bears on the inner surface of the flange 62 of the piston 6 and on the upper surface of the flange 73 of the rod 7, thus pushing the rod 7 away from the piston 6.

A centering stud 13 fixed to the partition 39 which carries a nozzle 11 for spraying the liquid, defines, with the nozzle 11, an annular spraying chamber communicating with the chamber 35.

The sealing between the neck 22 of the container 2 and the dispensing head 3 is provided using an annular seal 12 located between the upper edge of the neck 22 and the flat section 31.

The cylindrical body 33 is closed at the top by the cap 5 which is provided with a circular opening 51, for passage of the piston 6, and with a screw thread 52 interacting with the screw thread 36 of the cylindrical body 33.

The dispensing head 3 is protected by the cover 4 which includes a side skirt 41 provided, in the vicinity of its lower edge, with an inner collar 42 capable of interacting with the groove 25 of the container for snap fastening of the cover 4 onto the container 2. The cover 4 includes a lever 43 which is capable of pivoting with respect to a point situated on the side skirt 41 of the cap 4, in a vertical plane, and interacting with the end 61 of the piston 6. The contact between the lever 43 and the end 61 of the piston is made through a spherical bearing surface 44 on the lever 43. The side skirt 41 includes, facing the spray nozzle 11, a window 45. Since the spray nozzle 11 is fixed, the window 45 is smaller, which improves the aesthetic appearance of the assembly.

The assembly 1 functions as follows. At rest, the piston 6 is in the top position, the chamber 34 is full of liquid, the point 71 rests in the opening 37 and closes the communication between the chambers 34 and 35 in a leaktight manner under the action of the spring 8, and the ball 9 of the non-return valve rests in the opening 38 so as to close in a leaktight manner the communication between the chamber 34 and the container 2 containing the liquid. When the user desires to spray the liquid, he/she presses on the lever 43. The piston 6 slides in the chamber 34 on the rod 7, compressing the spring 8 (see FIG. 2). A hydraulic pressure is thus created within the chamber 34.

When the sum of the force on the rod 7 due to the pressure in the chamber 34 applied to the face 73*a*, at the section of the lip 72 plus the force due to the spring 8, becomes less than the force on the rod 7 due to the pressure in the chamber 34 applied to the face 73*b*, the point 71 rises. The dose of liquid contained in the chamber 34 passes into the chamber 35 where it is sprayed through the nozzle 11 (see FIG. 3). When the chamber 34 is empty, the point 71 returns down into the opening 37 on its seat.

Figure 4:
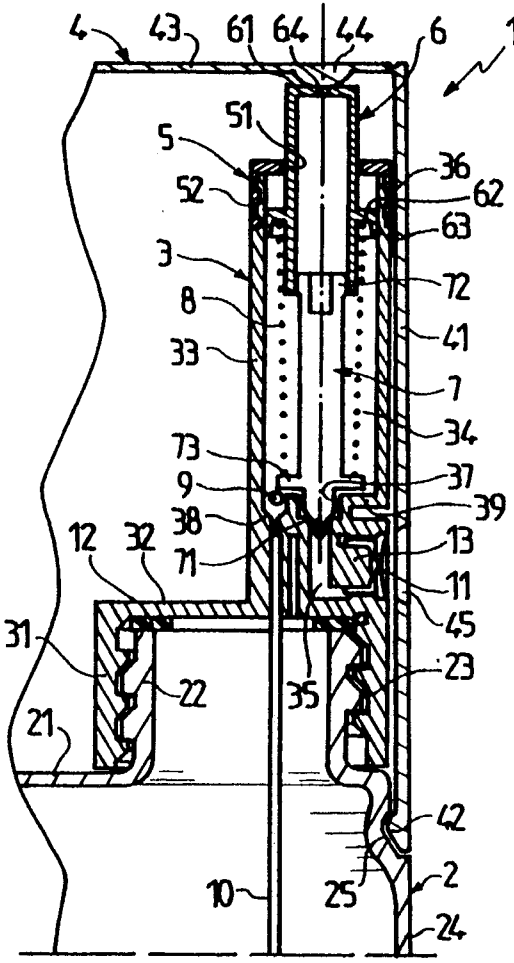
Figure 3:
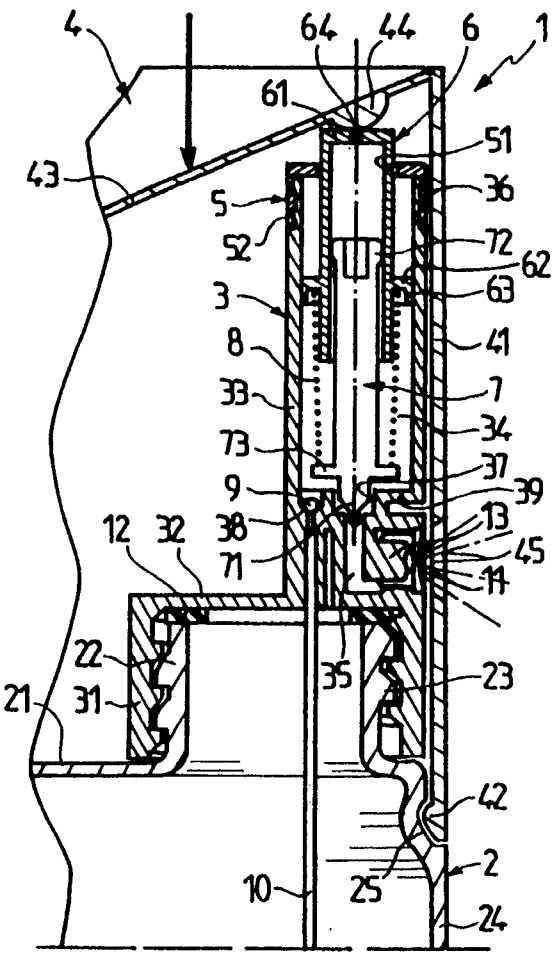

When the user stops pressing on the lever, the piston 6 rises back up under the action of the spring 8 (see FIG. 4). A reduced pressure is created inside the chamber 34, the ball 9 of the non-return valve is lifted from its seat 38 and is pressed under the flange 73. The liquid contained in the container 2 is sucked into the chamber 34 through the immersed tube 10. When the chamber 34 is full, the ball 9 falls back onto its seat 38.

Figure 5:
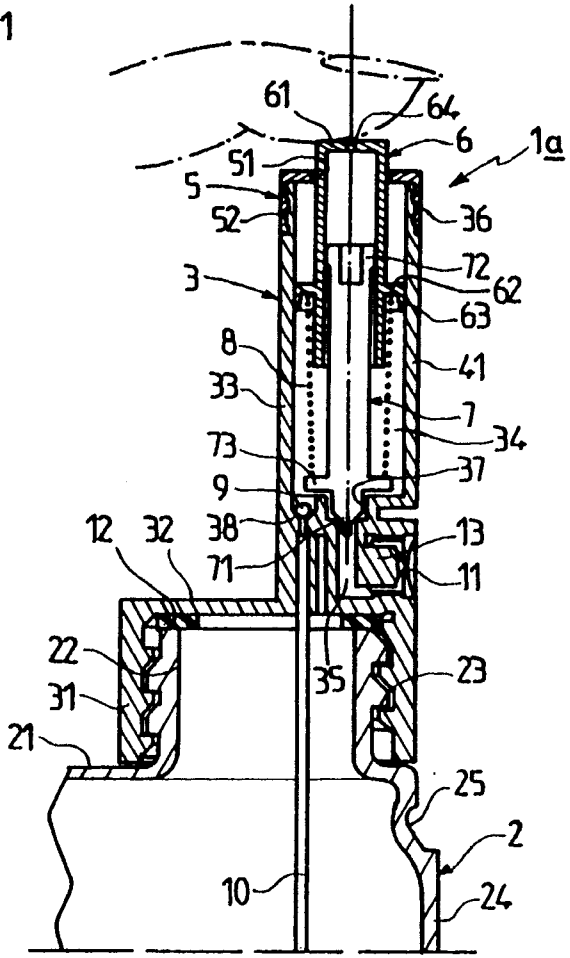
FIG. 5 represents an assembly identical to that in FIGS. 1 to 4, but not including a cover.

FIG. 5 illustrates an assembly 1*a* which is identical to the assembly 1 illustrated in FIGS. 1 to 4, except that the dispensing head 3 is not protected by a cover. In consequence, in order to carry out the spraying, the user presses with a finger directly on the end 61 of the piston 6.

Figure 6:
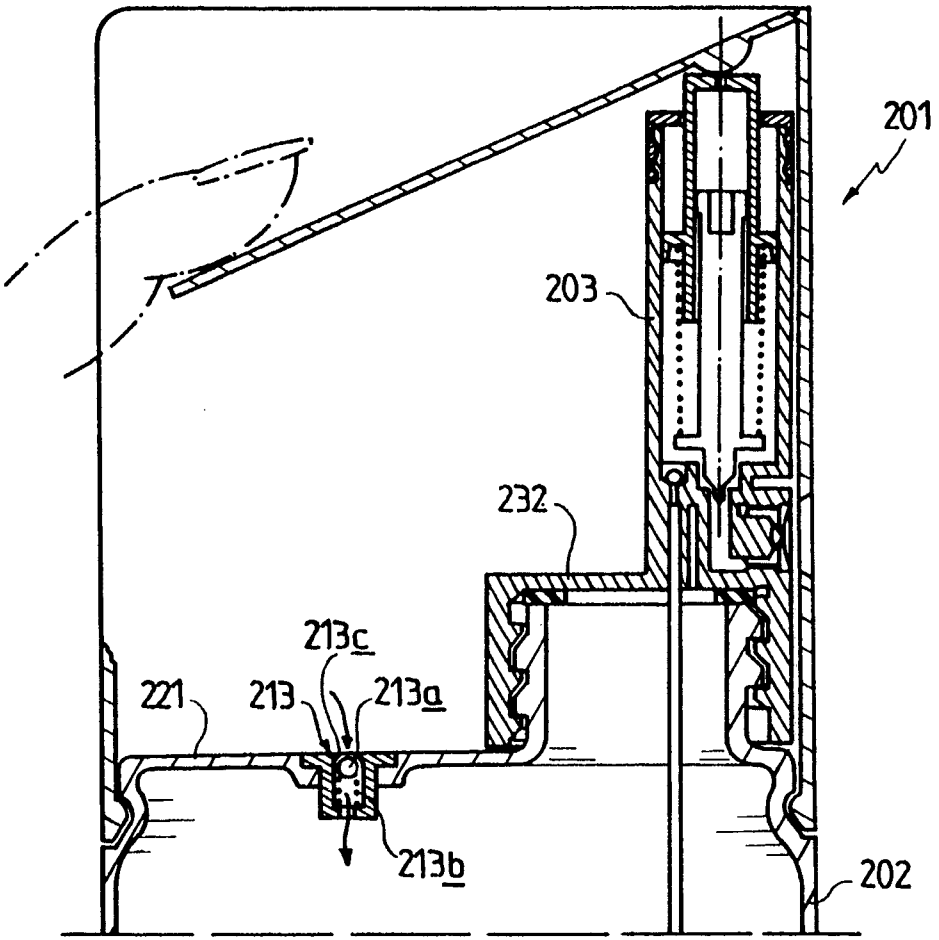
FIG. 6 represents, in longitudinal section, an assembly according to the invention of the type in FIGS. 1 to 4, but including in addition an air intake valve.
Figure 7:
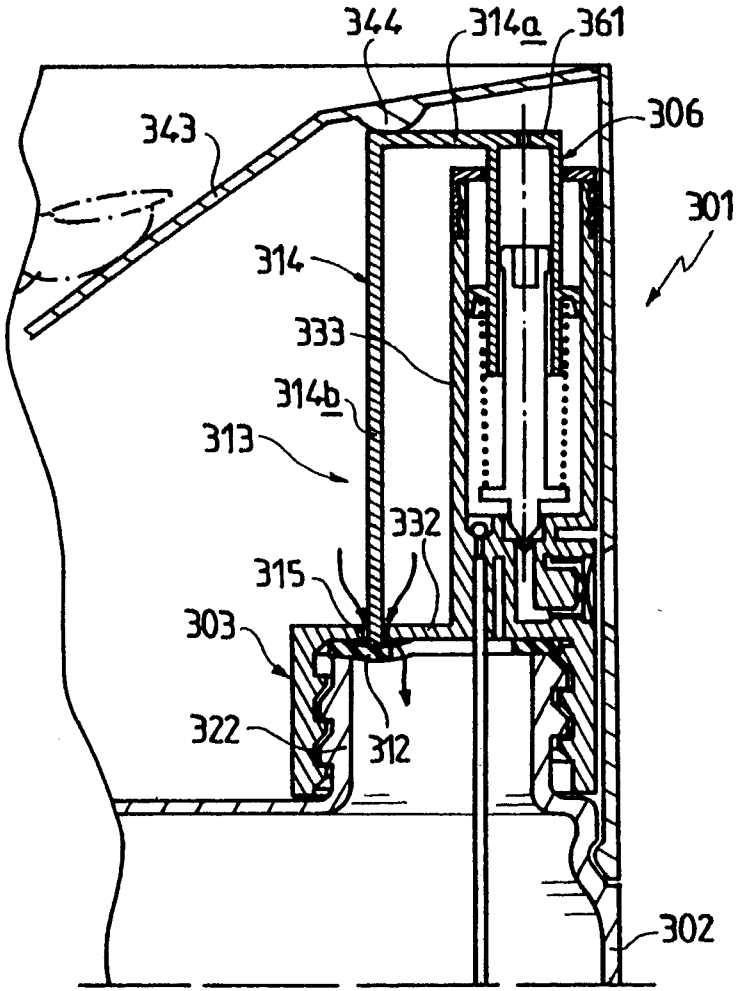
FIG. 7 represents, in longitudinal section, a variant of the assembly in FIG. 6.

FIGS. 6 and 7 represent assemblies 201 and 301, which are identical to that illustrated in FIGS. 1 to 4, with the exception that they include an air intake device 213, 313 respectively, making it possible to prevent the formation of reduced pressure in the containers 202 and 302 respectively. The containers 202 and 302 may therefore be made of rigid material.

The air intake device 213 illustrated in FIG. 6 is located on the upper wall 221 of the container 202. It should be noted that it might equally be located on the transverse flat section 232 of the dispensing head 203. The device 213 is a valve consisting of a ball 213*a*, a calibrated spring 213*b*, and a seat 213*c*, against which the ball 213*a* is pressed in a leaktight manner under the action of the spring 213*b* when the pressure inside the container 2 is equal to atmospheric pressure.

The air intake device 313 illustrated in FIG. 7 uses the annular seal 312 providing sealing between the edge of the neck 322 and the internal surface of the horizontal flat section 332 of the dispensing head 303. It includes a rod 314, including two elements 314*a* and 314*b* at right angles; the element 314*a* extends the upper surface 361 of the piston 306, and the element 314*b* is parallel to the axis of the body 333 and perpendicular to the flat section 332. The element 314*b* penetrates through an opening 315 made in the flat section 332 and comes into contact with the seal 312 providing sealing between the neck 322 and the plate 332.

The lever 343 bears via a bearing surface 344 on the element 314*a* of the rod 314. When the user presses on the lever 343, the piston 306 is driven in, the element 314*b* presses on the seal 312 which deforms until air penetrates the container 302 and returns the container 302 to atmospheric pressure.

Figure 8:
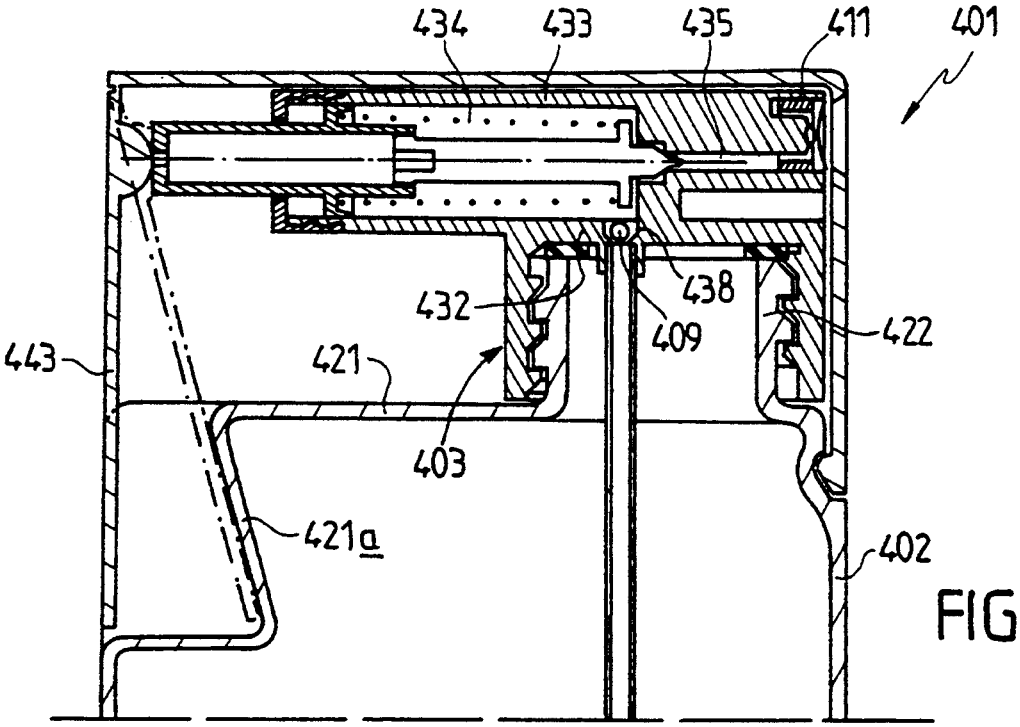
FIG. 8 represents, in longitudinal section, an assembly in which the longitudinal axis of the two chambers is perpendicular to the axis of the spray nozzle.

FIG. 8 illustrates an assembly 401 including a dispensing head 403 in which the longitudinal axis of the body 433 is perpendicular to the axis of the neck 422 of the container 402, that is to say horizontal as illustrated in FIG. 8. The wall of the cylindrical body 433 is fixed onto the flat section 432. Spraying through the nozzle 411 occurs parallel to the longitudinal axis of the body 433, the nozzle 411 being located in the end of the chamber 435. The seat 438 of the non-return ball valve 409 opens in the flat section 432 which also constitutes the wall of the body 433 at the chamber 434. In the embodiment illustrated in FIG. 8, the upper wall 421 of the container 402 includes a plane surface 421*a* which is inclined downwards towards the inside of the container 402 so as to allow movement of the lever 443 and to limit it. It should be noted that this embodiment makes it possible to reduce the height of the dispensing head.

Figure 9:
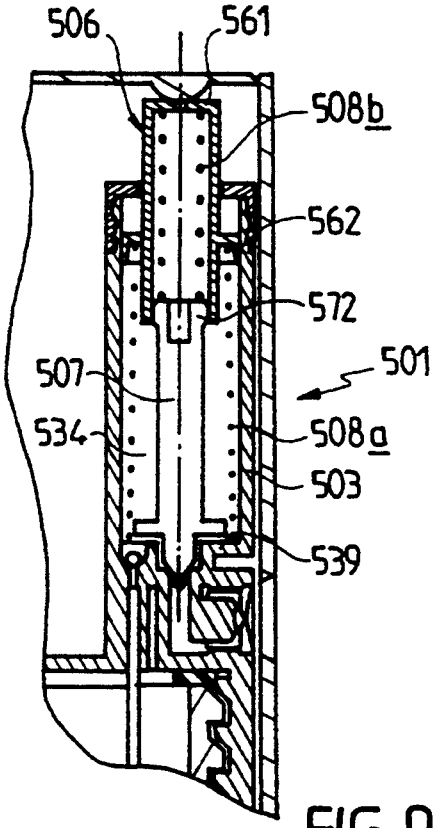
FIGS. 9 and 10 represent, in longitudinal section, an assembly according to the invention of the type of that in FIGS. 1 to 4, but including two elastic return means, at different stages of the spray phase.
Figure 10:
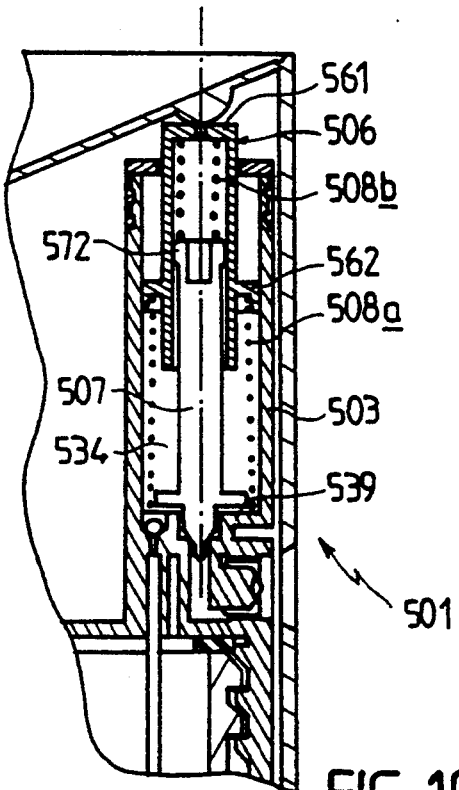

FIGS. 9 and 10 represent an assembly 501 which is similar to that represented in FIGS. 1 to 4, except that the piston 506 of the dispensing head 503 is returned by two springs 508*a* and 508*b*.

FIG. 9 represents the assembly 501 at rest, and FIG. 10 represents the assembly 501 during compression.

The spring 508*a* is located between the lower surface of the flange 562 of the piston 506 and the partition 539 forming the end of the chamber 534. The spring 508*b* is located in the piston 506. It connects the inner face of the end 561 of the piston 506 to the upper part 572 of the rod 507. The spring 508*a* is calibrated so that the force to be exerted to drive the piston into the chamber 534 is as small as possible. However, this spring 508*a* must be sufficiently stiff to cause the piston to rise back quickly. The spring 508*b* is calibrated more stiffly than the spring 508*a* so as to maximize the precompression of the liquid.

Figure 1:
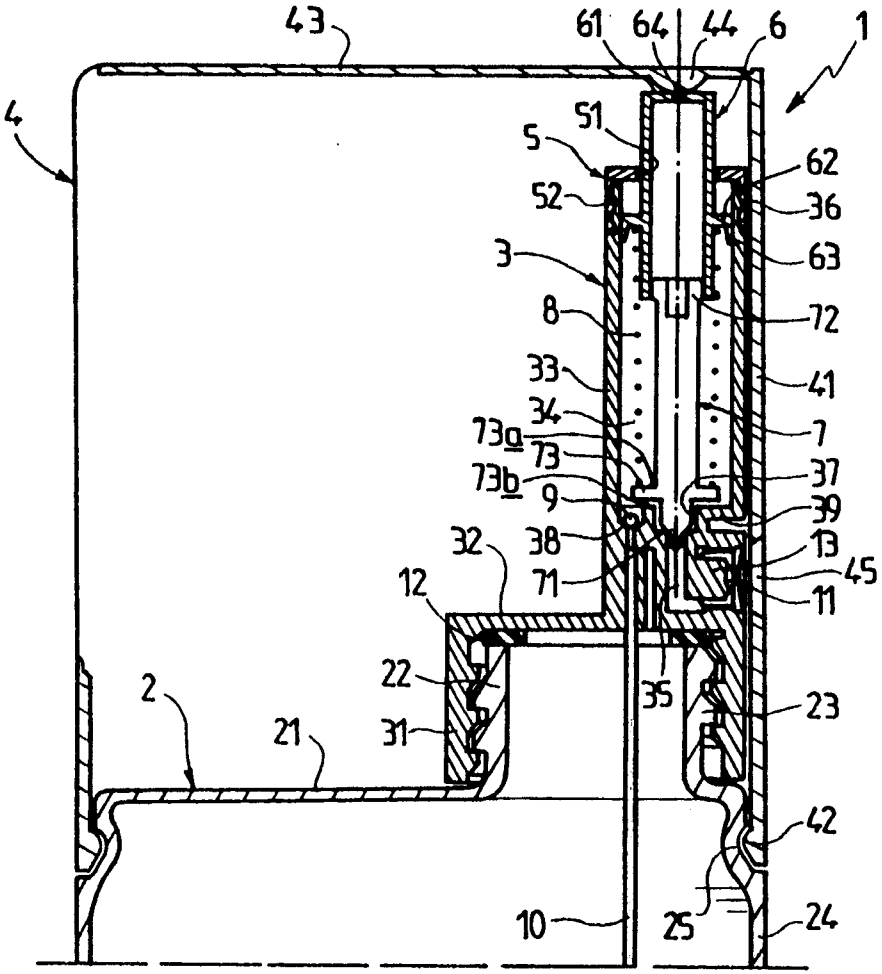
Figure 11:
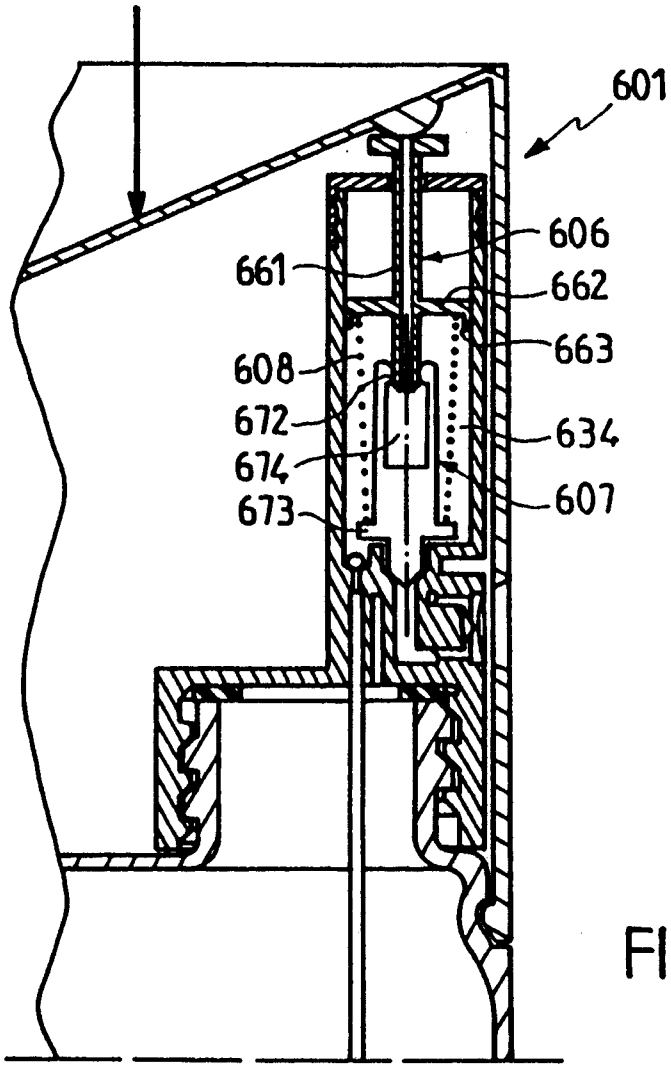

FIG. 11 represents an assembly 601 which is similar to the assembly represented in FIG. 1, except that the piston 606 slides in the rod 607 which is provided with a bore. The piston 606 consists of a cylindrical piece 661, opening at one end into the hollow of the rod 607, and at the other end to the outside, carrying a disc 662 provided with a sealing lip 663 which interacts with the inner surface of the chamber 634. The rod 607 includes a bore 674 in which the cylindrical piece 661 of the piston 606 slides. The upper edge of the bore 674 is provided with a sealing collar 672. A spring 608 surrounding the rod 607 bears, on the one hand, on the upper surface of a flange 673 of the rod 607 and, on the other hand, on the inner surface of the disc 662 of the piston 606, thus pushing the rod 607 away from the piston 606.

Figure 12:
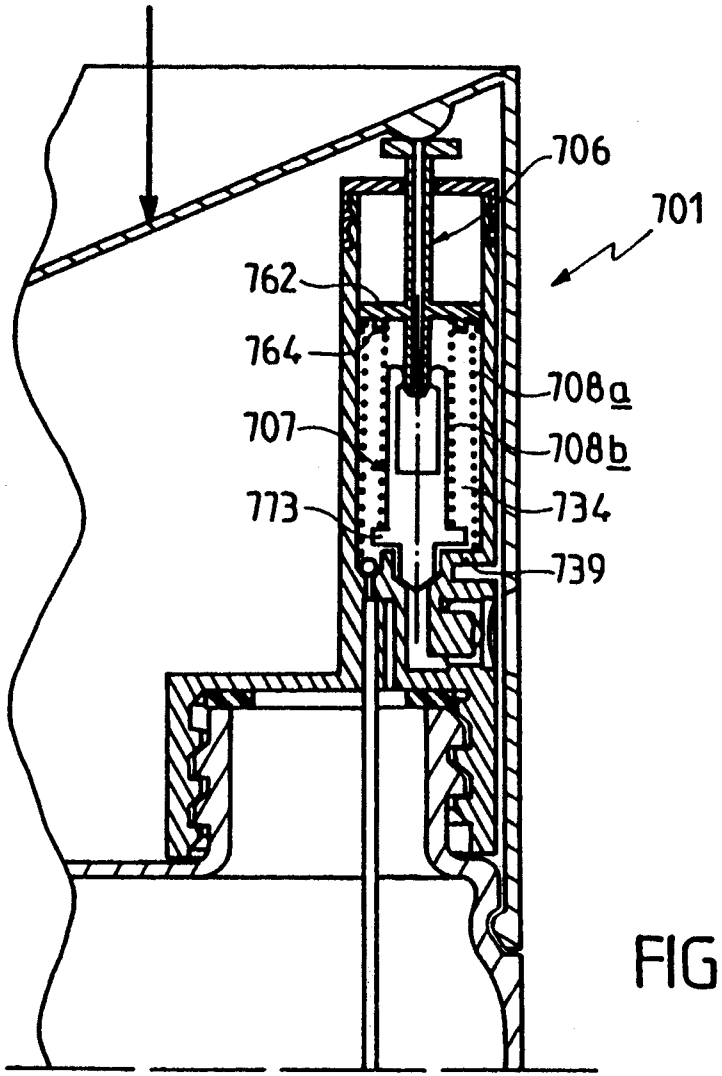
FIGS. 11–12 represent, in longitudinal section, assemblies in which the rod is provided with a bore and the piston slides in the rod; the assembly represented in FIG. 11 includes an elastic return means, and that represented in FIG. 12 includes two elastic return means.

FIG. 12 represents an assembly 701 which is identical to the assembly 601, except that the return means consists of two concentric springs 708*a* and 708*b*. The spring 708*a* bears, on the one hand, on the inner face of the disc 762 of the piston 706 and, on the other hand, on the partition 739 forming the end of the chamber 734. The spring 708*b* is located between the inner face of the disc 762 of the piston 706 and the upper face of the flange 773 of the rod 707. A circular rib 764, located on the inner face of the disc 762, separates the zones on the said inner face of the disc 762 against which the springs 708*a* and 708*b* bear.

I claim:

1. Assembly for spraying a liquid, comprising: a container for holding the liquid to be sprayed, said container having a neck and a dispensing head fixed on said neck, said dispensing head including a precompression pump having a first chamber and a second chamber, said first chamber being closed by a piston actuated manually from the outside against the action of at least one elastic return means and in communication with the container via a non-return valve, said second chamber being capable of communicating with the first chamber at the end of a precompression phase, and a spray nozzle, said first and second chambers being aligned on the same longitudinal axis, and having fixed walls which constitute a single body, said piston being mounted so as to slide with respect to a rod provided with a point capable of opening and closing communication between said first and second chambers, and said spray nozzle being located on a fixed wall of the second chamber.

2. Assembly according to claim 1, wherein the dispensing head further includes a cap closing the body and provided with an opening through which the piston passes.

3. Assembly according to claim 1, wherein the body has a skirt adapted to be fixed onto the neck of the container, said body having a cylindrical general shape and said first and second chambers being separated by a transverse partition having an opening which forms a passage between the first chamber and the second chamber, said second chamber emerging in the opening through an orifice which forms a seat for the point of the rod.

4. Assembly according to claim 1, wherein the rod carries a flange with a diameter less than that of the first chamber on which said at least one elastic return means bears.

5. Assembly according to claim 1, further including an air intake.

6. Assembly according to claim 1, wherein said at least one elastic return means comprise two elastic return means.

7. Assembly according to claim 1, wherein the spray nozzle has an axis and the body has a longitudinal axis which is arranged perpendicularly to the axis of the spray nozzle.

8. Assembly according to claim 1, wherein the spray nozzle has an axis and the body has a longitudinal axis which is arranged parallel to the axis of the spray nozzle.

9. Assembly according to claim 1, wherein the dispensing head is protected by a cover which includes a window arranged facing the spray nozzle.

10. Assembly according to claim 9, wherein the cover carries a lever for actuating the piston.

11. Assembly according to claim 1, wherein the rod is provided with a bore and the piston is mounted so as to slide in the bore.

12. Assembly according to claim 11, wherein the piston comprises a hollow cylindrical piece which carries a disc.

13. Assembly according to claim 12, wherein the rod carries a flange, and said at least one elastic return means are located between the disc of the piston and the flange of the rod.

14. Assembly according to claim 1, wherein the piston is hollow and the rod is mounted so as to slide in the piston.

15. Assembly according to claim 14, wherein the rod carries a lip which seals its sliding inside the piston.

16. Assembly according to claim 14, wherein the piston is a hollow cylinder carrying a flange provided with a sealing lip and closed at one end by a face capable of receiving means for actuating the piston.

17. Assembly according to claim 16, wherein the face of the piston is provided with a vent.

18. Assembly according to claim 17, wherein the rod carries a flange, and said at least one elastic return means are located between the flange of the piston and the flange of the rod.

* * * * *